US006791446B2

(12) United States Patent
Sato et al.

(10) Patent No.: US 6,791,446 B2
(45) Date of Patent: Sep. 14, 2004

(54) INDUCTANCE COMPONENT COMPRISING A PERMANENT MAGNET GREATER IN SECTIONAL AREA THAN A MAGNETIC PATH AND DISPOSED IN A MAGNETIC GAP

(75) Inventors: Mizuho Sato, Sendai (JP); Kazuyuki Okita, Sendai (JP); Toru Ito, Miyagi (JP); Gen Daigaku, Sendai (JP)

(73) Assignee: NEC Tokin Corporation, Sendai (JP)

( * ) Notice: Subject to any disclaimer, the term of this patent is extended or adjusted under 35 U.S.C. 154(b) by 56 days.

(21) Appl. No.: 10/157,697

(22) Filed: May 29, 2002

(65) Prior Publication Data

US 2002/0180575 A1 Dec. 5, 2002

(30) Foreign Application Priority Data

May 30, 2001 (JP) ..... 2001-163302

(51) Int. Cl.[7] ..... H01F 21/00
(52) U.S. Cl. ..... 336/110; 336/178
(58) Field of Search ..... 336/83, 110, 178, 336/200, 212, 233, 232; 335/299–302; 428/900

(56) References Cited

U.S. PATENT DOCUMENTS 5,349,320 A * 9/1994 Suzuki et al. ..... 336/92
5,464,670 A * 11/1995 Ikuma et al. ..... 428/35.8
6,328,817 B1 * 12/2001 Murakami ..... 148/105

FOREIGN PATENT DOCUMENTS

DE 29 51 313 A1 7/1981
EP 0 744 757 A1 11/1996
JP 62-234302 * 10/1987

* cited by examiner

*Primary Examiner*—Tuyen T. Nguyen
(74) *Attorney, Agent, or Firm*—Frishauf, Holtz, Goodman & Chick, P.C.

(57) ABSTRACT

An inductance component includes a magnetic core (11, 12) forming a magnetic circuit having a magnetic gap, an exciting coil (14) wound around the magnetic core, and a permanent magnet (13) disposed in the magnetic gap. The permanent magnet is greater in sectional area than the magnetic core.

14 Claims, 12 Drawing Sheets

INDUCTANCE COMPONENT COMPRISING A PERMANENT MAGNET GREATER IN SECTIONAL AREA THAN A MAGNETIC PATH AND DISPOSED IN A MAGNETIC GAP

BACKGROUND OF THE INVENTION

This invention relates to an inductance component which is a magnetic device such as a transformer and an inductor and, in particular, to an inductance component comprising a permanent magnet disposed in a magnetic gap formed in a magnetic core.

In order to reduce the size and the weight of an inductance component, it is effective to reduce the volume of a magnetic core comprising a magnetic material. Generally, the magnetic core reduced in size easily reaches magnetic saturation so that a current level handled by a power supply is inevitably decreased. In order to solve the above-mentioned problem, there is known a technique in which the magnetic core is provided with a magnetic gap formed at a part thereof. With this structure, a magnetic resistance of the magnetic core is increased so that the decrease in current level is prevented. In this case, however, the magnetic core is decreased in magnetic inductance.

In order to prevent the decrease in magnetic inductance, proposal is made of a technique related to such a structure that the magnetic core comprises a permanent magnet for generating a magnetic bias. In this technique, a d.c. magnetic bias is given to the magnetic core by the use of the permanent magnet. As a consequence, the number of magnetic lines of flux which can pass through the magnetic gap is increased.

However, the existing inductance component using the permanent magnet is disadvantageous in the following respect. That is, the insertion amount or volume of the permanent magnet disposed in the magnetic gap is determined by a sectional area of a middle leg portion of the magnetic core and the dimension of the magnetic gap. Thus, the magnetic bias given to the magnetic core is inevitably restricted.

SUMMARY OF THE INVENTION

It is therefore an object of this invention to provide an inductance component capable of increasing the insertion amount of a permanent magnet to thereby obtain an appropriate magnetic biasing effect without varying the dimension of a magnetic gap.

According to this invention, there is provided an inductance component comprising a magnetic core forming a magnetic circuit having a magnetic gap, an exciting coil wound around the magnetic core, and a permanent magnet disposed in the magnetic gap and greater in sectional area than the magnetic core.

BRIEF DESCRIPTION OF THE DRAWING

FIG. 1 is a perspective view of an inductance component according to a first embodiment of this invention with a part seen through;

FIG. 4 is a perspective view of an inductance component as a first comparative example with a part seen through;

FIG. 6 is a perspective view of a modification of the inductance component illustrated in FIG. 1 with a part seen through;

FIG. 7 is a perspective view of an inductance component according to a second embodiment of this invention with a part seen through;

DESCRIPTION OF THE PREFERRED EMBODIMENTS

Figure 1:
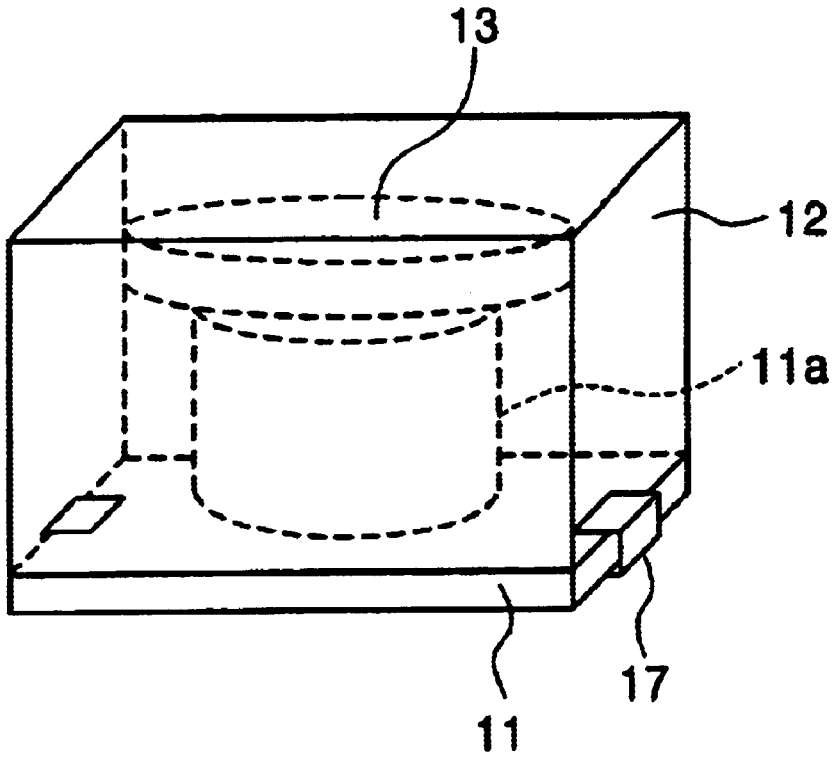
Figure 2:
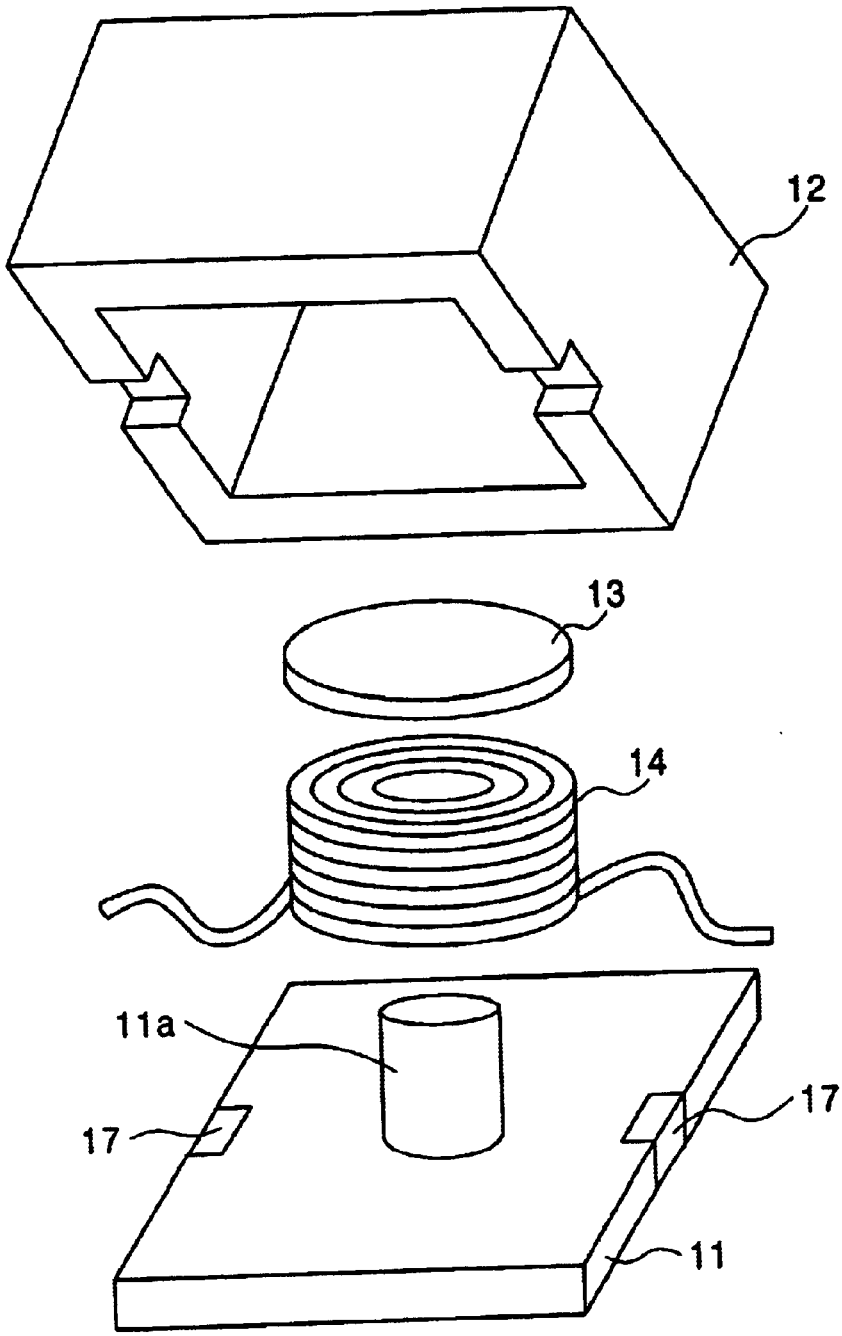
FIG. 2 is an exploded perspective view of the inductance component illustrated in FIG. 1.
Figure 3:
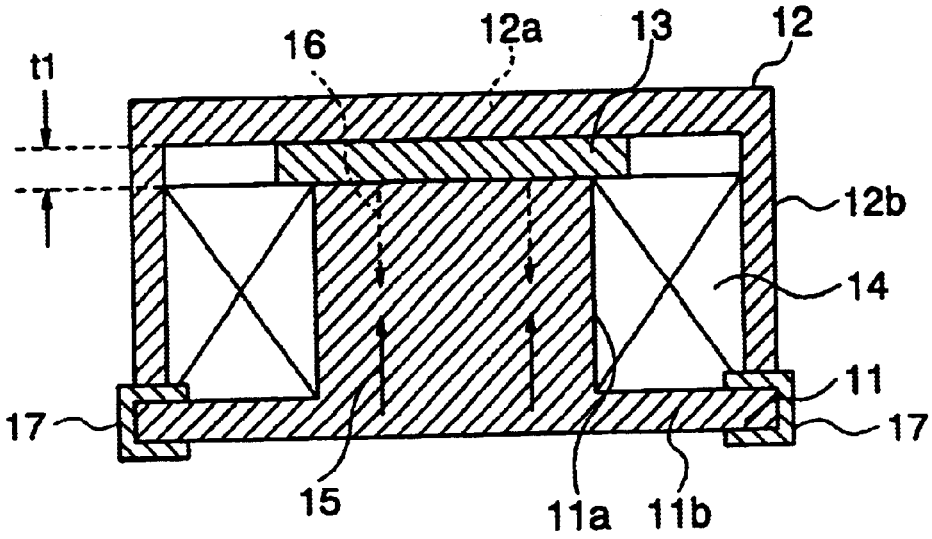
FIG. 3 is a side sectional view of the inductance component illustrated in FIG. 3.

Referring to FIGS. 1 through 3, description will be made of an inductance component according to a first embodiment of this invention The inductance component illustrated in FIGS. 1 through 3 is adapted to be used as a magnetic device such as a transformer and an inductor. The inductance component comprises a magnetic core composed of first and second core members 11 and 12 faced to each other. The first core member 11 has a cylindrical leg portion 11*a* at its center. The second core member 12 has a flat or plate-like portion 12*a* faced to one end of the leg portion 11*a* through a magnetic gap t1. The first core member 11 further has a flange portion 11*b* radially outwardly expanding from the other end of the leg portion 11*a*. The second core member 12 further has a tubular portion 12*b* extending from an outer peripheral end of the plate-like portion 12*a* to surround the leg portion 11*a* and connected to the flange portion 11*b*.

To the magnetic gap t1 of the magnetic core, a disc-shaped permanent magnet 13 is fitted. Between the leg portion 11*a* and the tubular portion 12*b*, an exciting coil 14 is arranged to surround the leg portion 11*a*. The permanent magnet 13 is arranged so that a magnetic field 16 generated by the permanent magnet 13 is opposite or reverse to a magnetic field 15 generated by the exciting coil 14. Thus, the magnetic field 16 by the permanent magnet 13 and the magnetic field 15 by the exciting coil 14 are opposite to each other. A terminal 17 is attached to an outer peripheral end of the flange portion 11*b* and connected to the exciting coil 14.

The magnetic core used herein defines a magnetic path having a magnetic path length of 1.75 cm, an effective sectional area of 0.237 $cm^2$, and a gap t1 of 230 $\mu$m. The exciting coil 14 has 10 turns and a d.c. resistance of 23 m Ω. The permanent magnet 13 has a thickness of 220 $\mu$m and a sectional area of 50.3 $mm^2$. Thus, the permanent magnet 13 is greater in sectional area than the magnetic path of the magnetic core.

Figure 4:
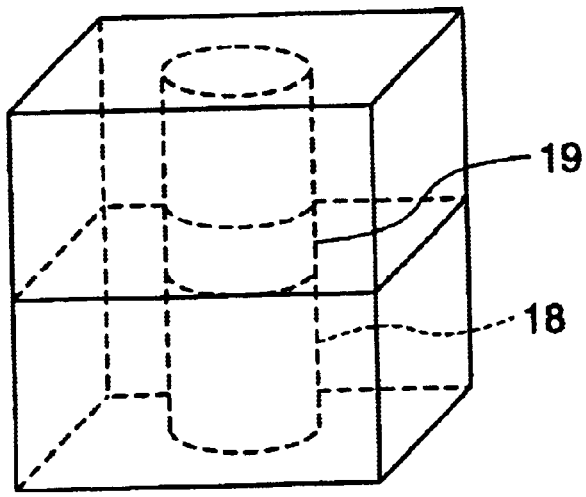

As illustrated in FIG. 4, preparation is made of an inductance component as a first comparative example which comprises a magnetic core having a middle leg portion 18 and a circular permanent magnet 19 having a sectional area of 23.8 $mm^2$ substantially similar to that of the middle leg portion 18. In addition, preparation is also made of an inductance component without using a permanent magnet.

Figure 5:
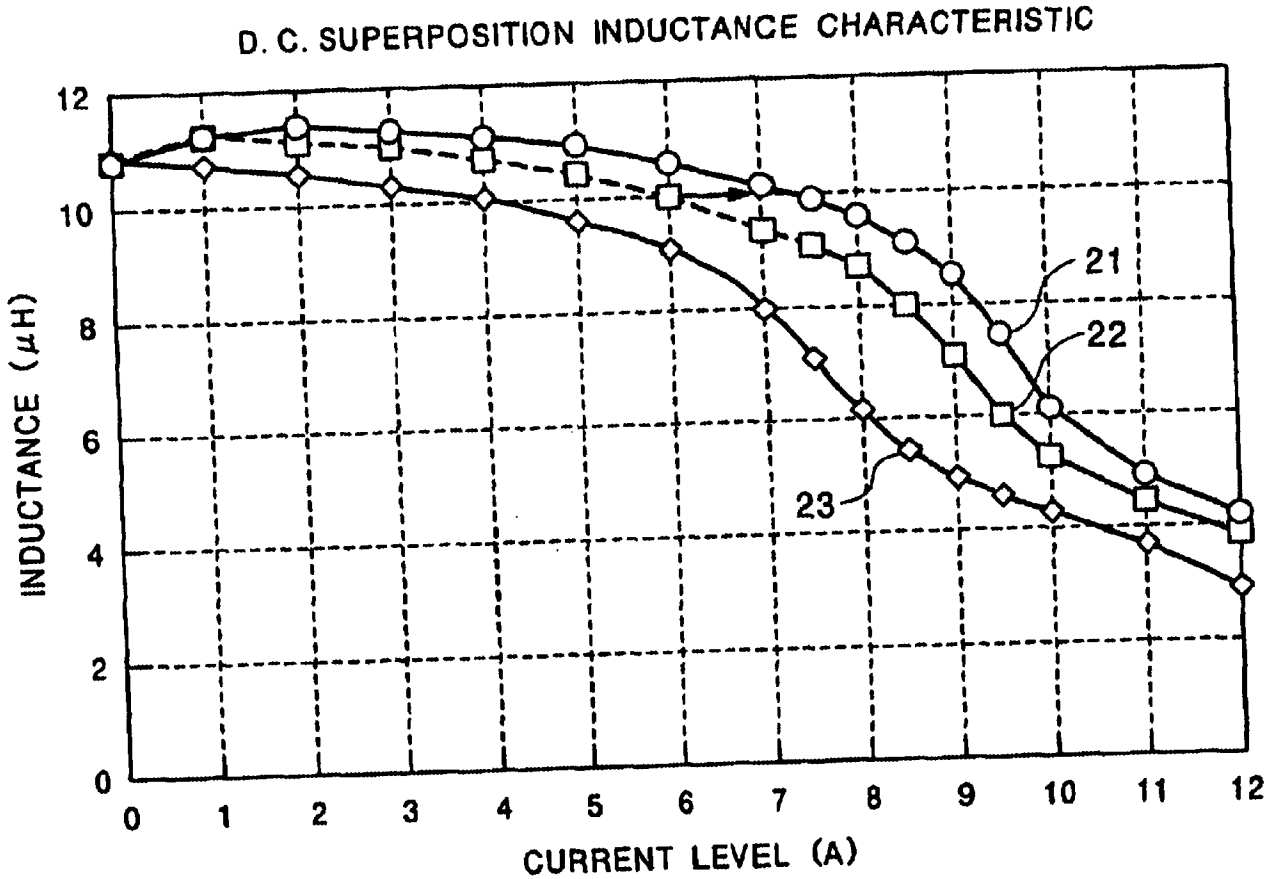
FIG. 5 is a graph showing a d.c. superposition inductance characteristic of the inductance component illustrated in FIG. 1 in comparison with those of the first comparative example in FIG. 4 and another example without using a magnetic bias.

For the inductance component in FIGS. 1 through 3, the inductance component in FIG. 4, and the inductance component without using the magnetic bias, d.c. superposition inductance characteristics are measured. The result is shown in FIG. 5. In FIG. 5, a solid line 21, a broken line 22, and a solid line 23 represent the d.c. superposition inductance characteristics of the inductance component in FIGS. 1 through 3, the inductance component in FIG. 4, and the inductance component without using the magnetic bias, respectively. As is obvious from FIG. 5, the inductance component in FIGS. 1 through 3 is improved in d.c. superposition inductance characteristic by 23% or more as compared with the inductance component in FIG. 4.

Figure 6:
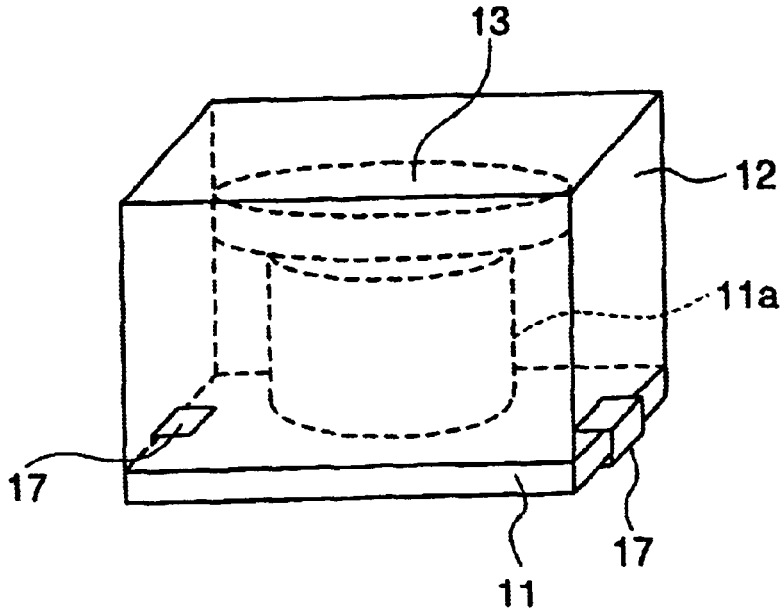

In FIG. 6, a modification of the inductance component in FIG. 1 is shown. As illustrated in the figure, the permanent magnet 13 has a circular section while the middle leg portion 11*a* of the first core member 11 has a rectangular section.

Figure 7:
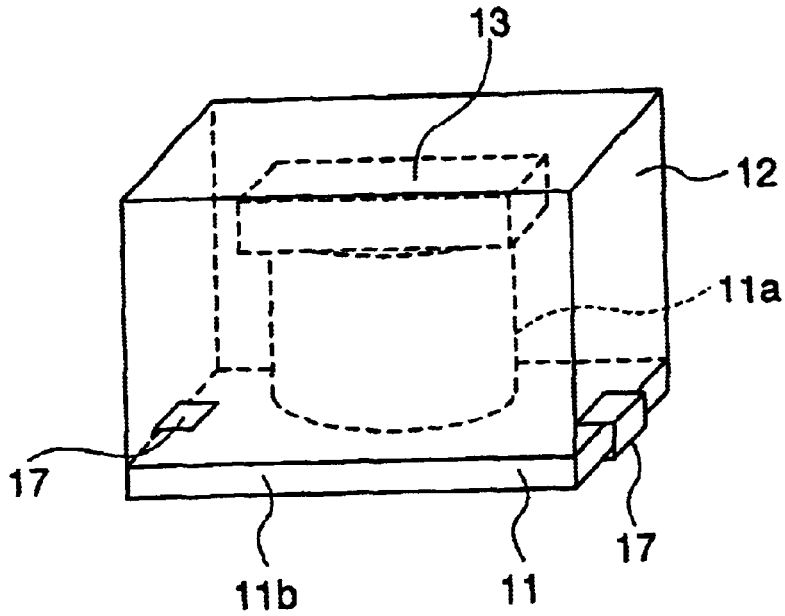
Figure 8:
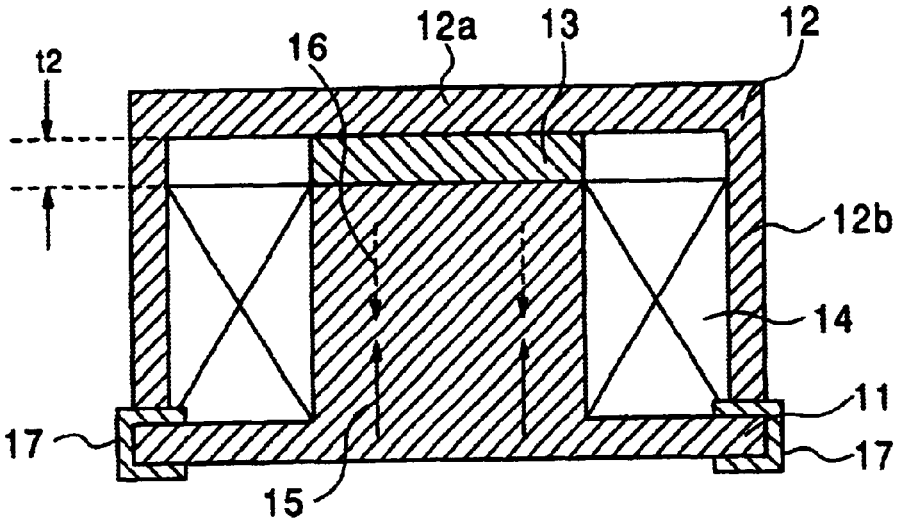
FIG. 8 is a side sectional view of the inductance component illustrated in FIG. 7.

Referring to FIGS. 7 and 8, description will be made of an inductance component according to a second embodiment of this invention. Parts similar in function to those of the inductance component illustrated in FIGS. 1 through 3 are designated by like reference numerals and detailed description thereof will be omitted.

The magnetic core used in this embodiment defines a magnetic path having a magnetic path length of 1.75 cm, an effective sectional area of 0.237 $cm^2$, and a gap t2 of 230 m Ω. The exciting coil 14 has 10 turns and a d.c. resistance of 23 m Ω. The leg portion 11*a* of the first core member 11 has a circular section. The permanent magnet 13 has a thickness of 220 $\mu$m and a rectangular shape (square shape) with an area of 30.25 $mm^2$.

Figure 9:
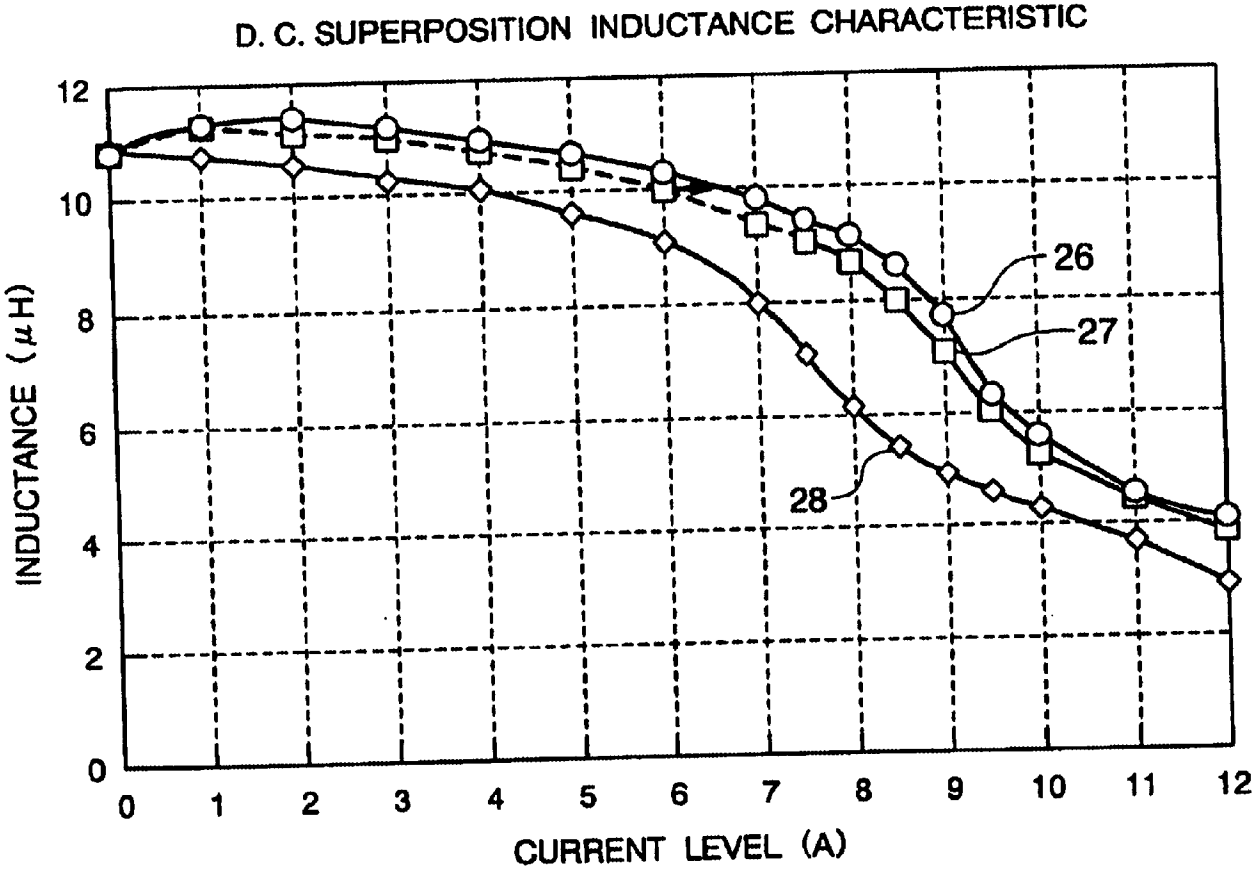
FIG. 9 is a graph showing a d.c. superposition inductance characteristic of the inductance component illustrated in FIG. 7 in comparison with those of the first comparative example in FIG. 4 and another example without using a magnetic bias.
Figure 10A:
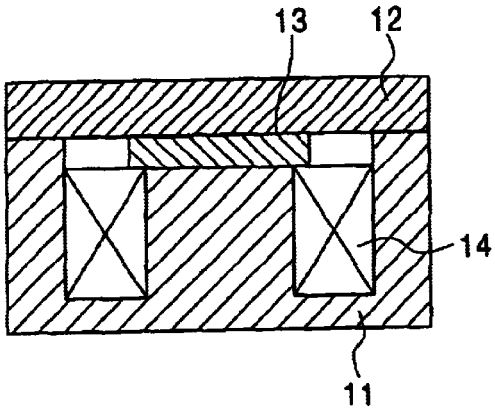
FIGS. 10A to 10D are side sectional views showing various modifications of the inductance component illustrated in FIGS. 1 to 3.
Figure 10B:
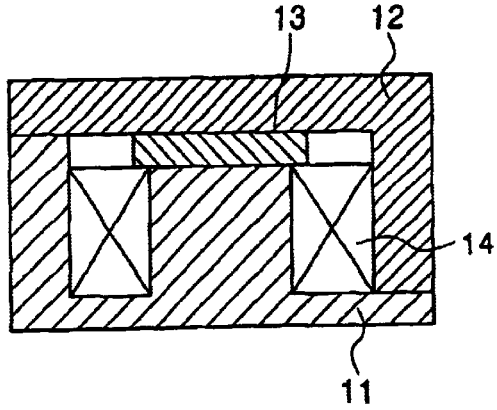
Figure 10C:
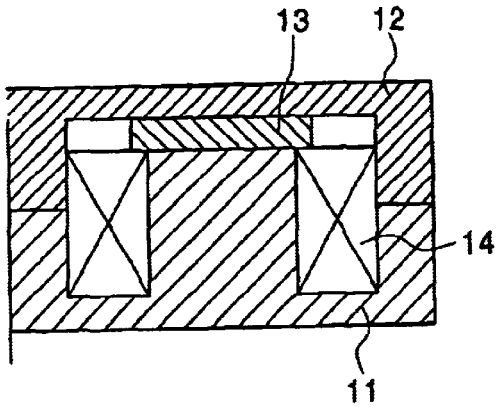
Figure 10D:
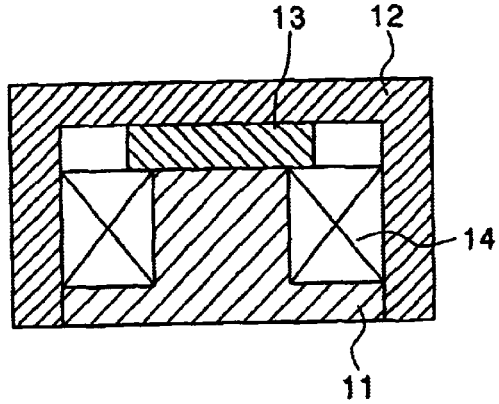

For the inductance component in FIGS. 7 and 8, the inductance component in FIG. 4, and the inductance component without using the magnetic bias, d.c. superposition inductance characteristics are measured. The result is shown in FIG. 9. In FIG. 9, a solid line 26, a broken line 27, and a solid line 28 represent the d.c. superposition inductance characteristics of the inductance component in FIGS. 7 and 8, the inductance component in FIG. 4, and the inductance component without using the magnetic bias, respectively. As is obvious from FIG. 9, the inductance component in FIGS. 7 and 8 is improved in d.c. superposition inductance characteristic by 8% or more as compared with the inductance component in FIG. 4. Furthermore, since the permanent magnet 13 has a rectangular section, it is possible to effectively utilize the material as compared with the circular section.

In each of the foregoing embodiment, the permanent magnet 13 preferably comprises (1) at least one resin selected from polyamide imide resin, polyimide resin, epoxy resin, polyphenylene sulfide resin, silicone resin, polyester resin, aromatic polyamide resin, and liquid crystal polymer and (2) rare earth magnet powder dispersed therein, having an intrinsic coercive force of 10 kOe or more, Tc of 500° C. or more, and an average particle size of 2.5–25 $\mu$m, and coated with at least one metal selected from Zn, Al, Bi, Ga, In, Mg, Pb, Sb, and Sn or alloy thereof. Preferably, the resin has a content of 30% or more in volumetric ratio and a specific resistance of 0.1 Ωcm or more.

The rare earth magnet powder preferably has a composition of $Sm(Co_{bal}.Fe_{0.15-0.25}Cu_{0.05-0.06}Zr_{0.02-0.03})_{7.0-8.5}$.

Preferably, the rare earth magnet powder is coated with an inorganic glass having a softening point between 220° C. and 550° C. Preferably, the metal or the alloy coating the rare earth magnet powder is further coated with a nonmetallic inorganic compound having a melting point not lower than 300° C. The amount of the metal or the alloy, the inorganic glass, or a combination of the metal or the alloy and the nonmetallic inorganic compound preferably falls within a range between 0.1 and 10% in volume.

During production of the permanent magnet, the rare earth metal powder is oriented in a thickness direction in a magnetic field of 25T or more so that the permanent magnet is provided with magnetic anisotropy. The permanent magnet desirably has a center line average roughness of 10 $\mu$m or less.

Each of the above-mentioned inductance component can be modified in various manners as illustrated in FIGS. 10A through 10D. Parts having similar functions are designated by like reference numerals. Thus, the shape of the first and the second core members 11 and 12 as well as the shape and the size of the permanent magnet 13 can be modified in various manners.

Figure 11:
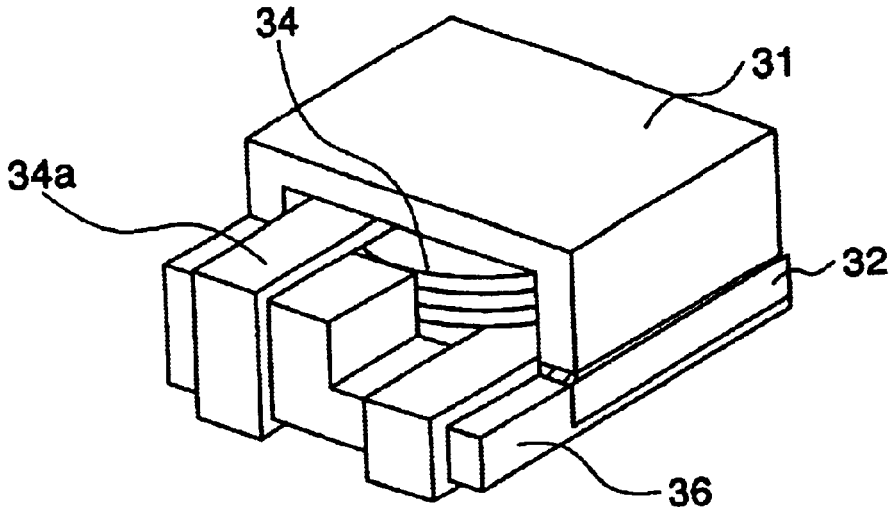
FIG. 11 is a perspective view of an inductance component according to a third embodiment of this invention.
Figure 12:
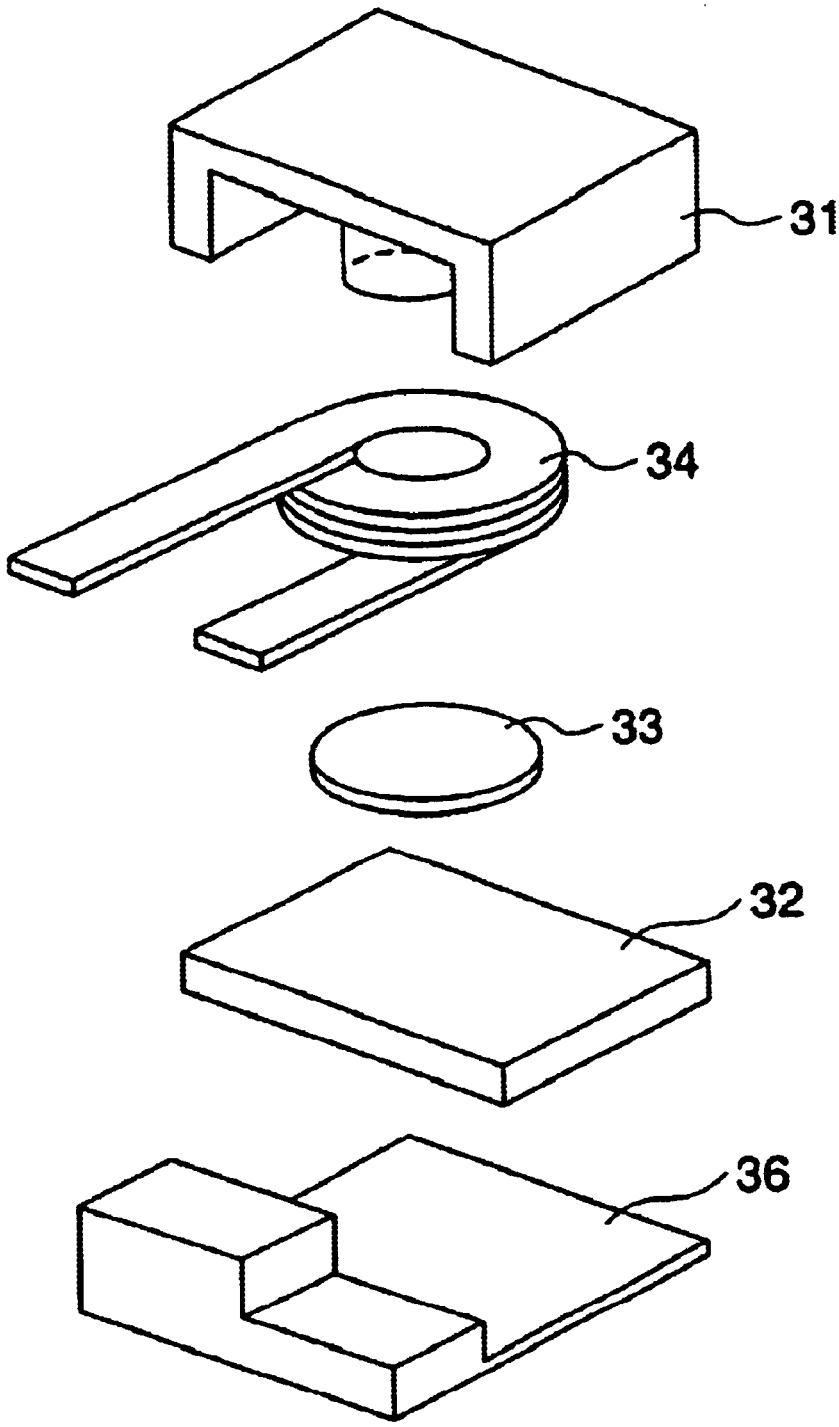
FIG. 12 is an exploded perspective view of the inductance component illustrated in FIG. 11.
Figure 13:
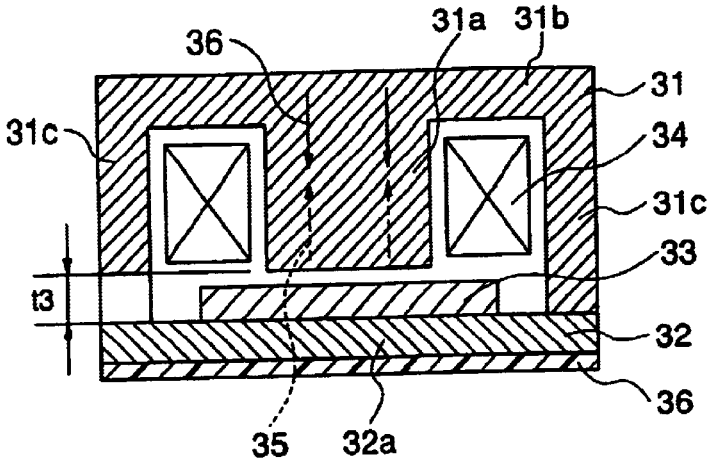
FIG. 13 is a side sectional view of the inductance component illustrated in FIG. 11.

Referring to FIGS. 11 through 13, description will be made of an inductance component according to a third embodiment of this invention.

The inductance component illustrated in FIGS. 11 through 13 is also adapted to be used as a magnetic device such as a transformer and an inductor. The inductance component comprises a magnetic core composed of first and second core members 31 and 32 faced to each other. The first core member 31 comprises an E-shaped magnetic core having a cylindrical leg portion 31*a* at its center. The second core member 32 comprises an I-shaped magnetic core having a plate-like portion 32*a* faced to one end of the leg portion 31*a* through a magnetic gap. The first core member 31 further has a flange portion 31*b* radially outwardly expanding from the other end of the leg portion 31*b* and a pair of side plate portions 31*c* extending from opposite ends of the flange portion 31*b* in parallel to the leg portion 31*a* and connected to the plate-like portion 32*a*.

To the magnetic gap, a permanent magnet 33 is fitted. Between the leg portion 31*a* and the side plate portions 31*c*, an exciting coil 34 is arranged to surround the leg portion 31*a*. The permanent magnet 33 is arranged so that a magnetic field 36 generated by the permanent magnet 33 is opposite or-reverse to a magnetic field 35 generated by the exciting coil 34. Thus, the magnetic field 36 by the permanent magnet 33 and the magnetic field 35 by the exciting coil 34 are opposite to each other.

An insulating base 36 is attached to the plate-like portion 32*a*. The insulating base 36 is a resin molded product. The exciting coil 34 has a portion 34*a* extending on or over the insulating base 36 to serve as a terminal known in the art.

The first and the second core members 31 and 32 are made of Mn—Zn ferrite and define a magnetic path having a magnetic path length of 12.3 mm and an effective sectional area, i.e., a sectional area of the leg portion 31*a*, of 8.0 $mm^2$. The magnetic path has a magnetic gap t3 equal to 200 $\mu$m. The permanent magnet 33 has a disc shape with a thickness of 150 $\mu$m and a diameter of 5 mm. Therefore, the permanent magnet 33 is greater in sectional area than the magnetic path of the magnetic core. The exciting coil 34 has 3 turns.

Comparison will be made between the inductance component in FIGS. 11 to 13 and the inductance component in FIGS. 1 to 3. The leg portion 31*a*, the flange portion 31*b*, the side plate portions 31*c*, the plate-like portion 32*a*, the permanent magnet 33, and the exciting coil 34 correspond to the leg portion 11*a*, the flange portion 11*b*, the tubular portion 12*b*, the plate-like portion 12*a*, the permanent magnet 13, and the exciting coil 14, respectively. Therefore, the inductance component in FIGS. 11 to 13 may be modified in the manner similar to those mentioned in conjunction with the first embodiment.

Figure 14:
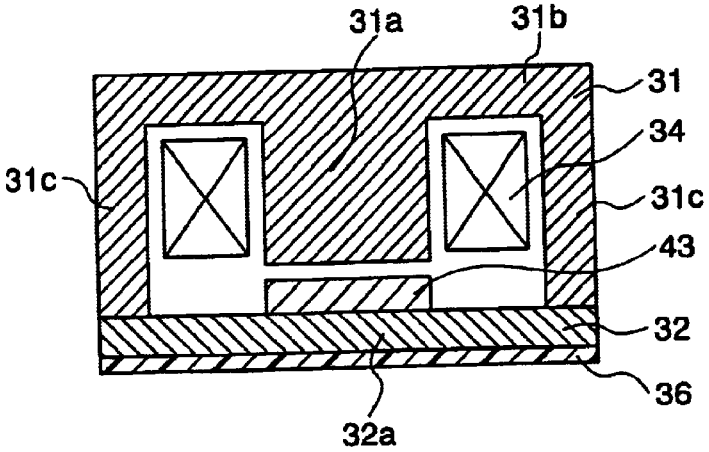
FIG. 14 is a side sectional view of an inductance component as a second comparative example.

As a second comparative example, an inductance component illustrated in FIG. 14 is prepared. In the inductance component in FIG. 14, the permanent magnet 33 is replaced by a permanent magnet 43 having an area (8.0 $mm^2$) equal to that of the leg portion 31*a* of the inductance component in FIGS. 11 to 13. The permanent magnet 43 is equal in thickness to the permanent magnet 33.

Figure 15:
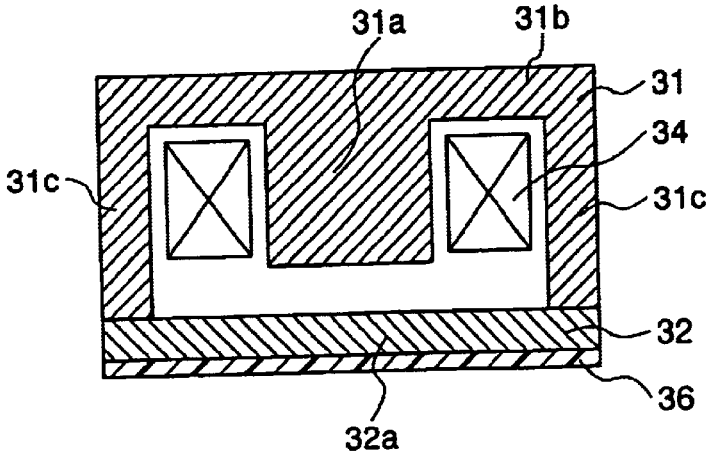
FIG. 15 is a side sectional view of an inductance component as a third comparative example.

As a third comparative example, an inductance component illustrated in FIG. 15 is prepared. The inductance component illustrated in FIG. 15 has nothing equivalent or corresponding to the permanent magnet 33 of the inductance component in FIGS. 11 to 13.

Figure 16:
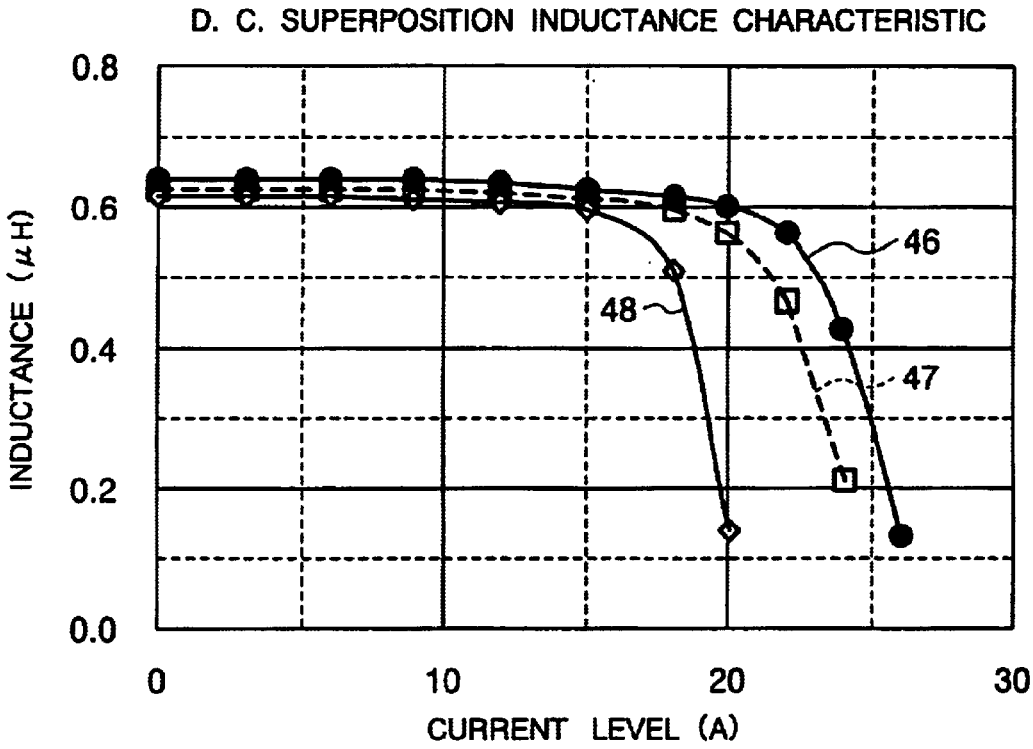
FIG. 16 is a graph showing a d.c. superposition inductance characteristic of the inductance component illustrated in FIG. 11 in comparison with those of the second comparative example in FIG. 14 and the third comparative example in FIG. 15.

For the inductance components in FIGS. 11 to 13, FIG. 14, and FIG. 15, d.c. superposition inductance characteristics are measured. The result is shown in FIG. 16. In FIG. 16, a solid line 46, a broken line 47, and a solid line 48 represent the d.c. superposition inductance characteristics of the inductance components in FIGS. 11 to 13, FIG. 14, and FIG. 15, respectively. As is obvious from FIG. 16, the inductance component in FIGS. 11 to 13 is improved in d.c. superposition inductance characteristic by 25% or more as compared with the inductance component in FIG. 14.

What is claimed is:

1. An inductance component comprising:

a magnetic core comprising ferrite and forming a magnetic circuit having a magnetic gap;

an exciting coil wound around said magnetic core; and a permanent magnet disposed in said magnetic gap and having a greater sectional area than said magnetic core;

wherein said permanent magnet comprises:

at least one resin selected from polyamide imide resin, polyimide resin, epoxy resin, polyphenylene sulfide resin, silicone resin, polyester resin, aromatic polyamide resin, and liquid crystal polymer; and rare earth magnet powder dispersed in said at least one resin, said rare earth magnet powder having an intrinsic coercive force of at least 10 kOe, a Tc of at least 500° C., and an average particle size of approximately 2.5–25 $\mu$m, and being coated with at least one metal selected from Zn, Al, Bi, Ga, In, Mg, Pb, Sb, and Sn or alloy thereof, and wherein said resin has a content of at least 30% in volumetric ratio and a specific resistance of at least 0.1 Ωcm.

2. The inductance component according to claim 1, wherein said rare earth magnet powder has a composition of Sm(Cobal.Fe0.15–0.25Cu0.05–0.06Zr0.02–0.03) 7.0–8.5.

3. The inductance component according to claim 1, wherein said rare earth magnet powder is coated with an inorganic glass having a softening point between 220° C. and 550° C.

4. The inductance component according to claim 1, wherein said metal or said alloy coating said rare earth magnet powder is further coated with a nonmetallic inorganic compound having a melting point not lower than 300° C.

5. The inductance component according to claim 1, wherein the amount of said metal or said alloy, said inorganic glass, or a combination of said metal or said alloy and said nonmetallic inorganic compound falls within a range between 0.1 and 10%.

6. The inductance component according to claim 1, wherein said rare earth magnet powder is oriented in a magnetic field applied during production of said permanent magnet so that said permanent magnet is provided with magnetic anisotropy.

7. The inductance component according to claim 1, wherein said permanent magnet has a center line average roughness of 10 $\mu$m or less.

8. The inductance component according to claim 1, wherein said magnetic core comprises first and second core members facing each other, said first core member comprising a leg portion, and said second core member comprising a plate-like portion facing a first end of said leg portion through said magnetic gap.

9. The inductance component according to claim 8, wherein said first core member further comprises a flange portion expanding radially outward from a second end of said leg portion, and said second core member further comprises a tubular portion extending from an outer peripheral end of said plate-like portion to surround said leg portion of said first core member, and wherein said tubular portion of said second core member is connected to said flange portion of said first core member.

10. The inductance component according to claim 9, wherein said exciting coil is arranged between said leg portion of said first core member and said tubular portion of said second core member to surround said leg portion.

11. The inductance component according to claim 9, further comprising a terminal that is attached to an outer peripheral end of said flange portion of said first core member and that is connected to said exciting coil.

12. The inductance component according to claim 8, wherein said first core member further comprises a flange portion expanding radially outward from a second end of said leg portion, and at least one side plate portion extending parallel to said leg portion from an outer peripheral end of said flange portion, and wherein said at least one side plate portion is connected to said plate-like portion of said second core member.

13. The inductance component according to claim 12, wherein said exciting coil is arranged between said leg portion of said first core member and said side plate portion of said first core member to surround said leg portion.

14. The inductance component according to claim 13, further comprising an insulating base attached to said plate-like portion of said second core member, and wherein said exciting coil has a portion extending over said insulating base to serve as a terminal.

* * * * *